US006648553B2

(12) United States Patent
Rolfsnes

(10) Patent No.: US 6,648,553 B2
(45) Date of Patent: Nov. 18, 2003

(54) LOAD TRANSFER UNIT AND METHOD FOR REMOVING OFF-SHORE PLATFORM FROM SUBSTRUCTURE

(75) Inventor: Geir Rolfsnes, Stavanger (NO)

(73) Assignee: Marine Shuttle Operations AS, Sandnes (NO)

( * ) Notice: Subject to any disclaimer, the term of this patent is extended or adjusted under 35 U.S.C. 154(b) by 0 days.

(21) Appl. No.: 10/071,085

(22) Filed: Feb. 11, 2002

(65) Prior Publication Data

US 2002/0108553 A1 Aug. 15, 2002

(30) Foreign Application Priority Data

Feb. 9, 2001 (NO) ..... 2001 0703

(51) Int. Cl.[7] ..... E02D 25/00

(52) U.S. Cl. ..... 405/209; 405/196; 405/206; 403/13; 114/125; 114/259

(58) Field of Search ..... 405/195.1, 196, 405/203–206, 209, 221, 290, 291, 295; 403/13, 14; 114/121, 125, 44, 45, 50, 259; 188/268, 371

(56) References Cited

U.S. PATENT DOCUMENTS

| | | | | | |
|---|---|---|---|---|---|
| 3,750,853 | A | * | 8/1973 | Farr | 188/268 |
| 3,751,020 | A | * | 8/1973 | Kendall et al. | 188/268 |
| 4,069,680 | A | * | 1/1978 | Erler | 405/224 |
| 4,212,345 | A | * | 7/1980 | Pemper | 188/264 B |
| 4,453,859 | A | * | 6/1984 | Sedillot et al. | 405/202 |
| 4,556,004 | A | | 12/1985 | Lamy et al. | |
| 4,607,982 | A | | 8/1986 | Brasted et al. | |
| 4,662,788 | A | * | 5/1987 | Kypke et al. | 405/204 |
| 4,761,097 | A | * | 8/1988 | Turner | 405/204 |
| 4,848,967 | A | * | 7/1989 | Weyler | 405/204 |
| 4,930,938 | A | * | 6/1990 | Rawstron et al. | 405/204 |
| 4,973,200 | A | * | 11/1990 | Kaldenbach | 405/205 |
| 5,111,764 | A | * | 5/1992 | D'Ettorre | 114/259 |
| 5,219,451 | A | | 6/1993 | Datta et al. | |
| 5,403,124 | A | * | 4/1995 | Kocaman et al. | 405/209 |
| 5,413,436 | A | * | 5/1995 | Merz | 405/290 |
| 5,553,977 | A | * | 9/1996 | Andersen et al. | 405/204 |
| 5,829,919 | A | * | 11/1998 | Heerema | 405/209 |
| 6,027,287 | A | | 2/2000 | Faldini | |
| 6,209,474 | B1 | * | 4/2001 | Foss et al. | 114/125 |
| 6,276,875 | B1 | * | 8/2001 | Gunnar et al. | 405/203 |
| 6,299,383 | B1 | * | 10/2001 | Finn et al. | 405/209 |

FOREIGN PATENT DOCUMENTS

| | | | | |
|---|---|---|---|---|
| GB | 2083112 | * | 3/1982 | 405/203 |
| GB | 2 165 188 A | | 4/1986 | |
| GB | 2 363 814 A | | 1/2002 | |
| WO | WO 98/24980 | | 6/1998 | |
| WO | WO 99/06270 | | 2/1999 | |

* cited by examiner

*Primary Examiner*—Jong-Suk Lee
(74) *Attorney, Agent, or Firm*—Birch, Stewart, Kolasch & Birch, LLP

(57) ABSTRACT

A platform topsides can be transferred from a substructure to a transporter by ballasting the transporter, locating the transporter underneath the topsides and deballasting the transporter, causing load transfer units of the transporter to lift the topsides off the substructure. Each load transfer unit comprises a compression spring which rests on a layer of particulate material located in a drum, the particulate material in turn rests on a releasable hatch-cover. The springs provide a flexible connection between the transporter and the topsides. During the deballasting of the transporter, the hatch-covers are released to suddenly let out the particulate material from the drums, thereby lowering and relieving the springs, causing a direct contact and a stiff connection between the transporter and the topsides.

14 Claims, 4 Drawing Sheets

LOAD TRANSFER UNIT AND METHOD FOR REMOVING OFF-SHORE PLATFORM FROM SUBSTRUCTURE

FIELD OF THE INVENTION

The invention relates to a method for removing a platform topsides from a substructure by a floatable, ballastable transporter floating in the sea, in which the transporter is possibly moving due to motions of the sea. The invention further relates to a load transfer unit of a floatable, ballastable transporter, for transferring load from a platform topsides to the transporter during removal of the topsides from a substructure, which removal is carried out by ballasting the transporter, locating the transporter underneath the topsides and deballasting the transporter, causing load transfer units of the transporter to contact and lift the topsides off the substructure. The invention also relates to a combination of a load transfer unit and a lift-bracket attached to an underside of the topsides.

DESCRIPTION OF BACKGROUND ART

An offshore platform consists of a substructure made from steel or concrete and a topsides comprising one or more decks, production equipment and other facilities which are required to exploit a subsea hydrocarbon reserve. Offshore platforms can also be used for other purposes, e.g. injecting water or gas in the reservoirs, or as living quarters for offshore personnel. When their life-time are ended, the offshore platforms should from an environmental point of view be removed.

Normally, due to the great size of an offshore platform, the topsides will have to be removed first, followed by a removal of the substructure. The topsides may be removed by the method of the invention and similar methods, in which a transporter is ballasted, located underneath the topsides and deballasted to thereby mate with the topsides and lift the topsides off the substructure. In this patent application "transporter" shall mean any kind of transporter, including barges and ships, capable of carrying out such a removal of a topsides.

Topsides' and transporters are heavy structures, and the transfer of the weight of a topsides from the substructure to the transporter is related to various technical problems. One problem is to align several contact points of the transporter with corresponding contact points of the topsides. Another problem is impacts which will normally occur when the transporter contacts the topsides. A further problem is that complete simultaneous and even contact of several contact points are practically difficult to achieve, which may cause an uneven load distribution. In isolation or together these problems may cause damage both to the transporter and the topsides. To solve these problems both the transporter and the topsides may be provided with some kind of load transfer structures.

Many places, like in the North Sea, there is heavy seas, and almost always the transporter will be moving in the sea prior to the mating with the topsides. If no precautions are made, the motions of the transporter strongly worsen the above discussed problems. Elliptical horizontal motions induced by the combined effect of yaw, surge and sway will worsen the problem of aligning the contacts points of the transporter with the contact points of the topsides. Elliptical vertical motions induced by the combined effect of heave, pitch and roll will cause the transporter to repeatingly contact and lose contact with the topsides during the deballasting of the transporter, causing a number of impacts. This will last until the transporter is deballasted so much that the buoyancy of the transporter is big enough to maintain the contact during a downwardly directed heave movement. Rotating motion, known as roll, pitch and yaw, will worsen the problem of uneven contact between several contact points.

When transferring a heavy topsides from a substructure to a transporter when the transporter is moving, it is required first to establish contact between the topsides and the transporter, and then, when the contact is established, carry out the actual transfer of the weight of the topsides and lift the topsides off the substructure. For simplicity the first phase is called the contact phase, while the second phase is called the lift-off phase. During the contact phase, to avoid that the great mass of the moving transporter creates forces which cause damage, the connection between the topsides and the transporter must be flexible. During the lift-off phase, however, to ensure a stable lift-off, the connection between the topsides and the transporter must be stiff.

WO 99/06270 describes a transporter comprising pontoons which define a moonpool with an open side for the location of a substructure, and a topsides load transfer structure above the pontoons. The transporter can be ballasted and then moved into a position in which it is located underneath the topsides and embraces the substructure, i.e. the substructure is in the moonpool. The transporter can then be deballasted, and the topsides load transfer structure contacts the underside of the topsides and lifts the topsides off the substructure. The transporter can then transport the topsides to a receiver, e.g. a construction yard. The load transfer structure of WO 99/06270 is static, and is not able to provide a solution to the problems of transferring the weight of a topsides from the substructure to the transporter if the sea is in motion.

U.S. Pat. No. 4,607,982 discloses an installation of a platform topsides upon a previously installed substructure. The topsides is mounted on a barge positionable between legs of the substructure. The barge can be ballasted and lowered a sufficient distance to allow leg elements of the topsides to contact and mate with leg support elements of the substructure. Impacts between the structures during the mating operation are absorbed by resilient neoprene pads carried by the leg supports. After the platform structure rests upon the leg supports, the barge is removed, and the platform structure is lowered and levelled by draining a select volume of sand from the leg supports. The system involves a complex use of valved tubing and instrumentation to control the levelling and lowering.

U.S. Pat. No. 5,219,451 discloses a barge for locating a topsides on a previously installed substructure. The topsides is located on the barge, and the barge is positioned between legs of the substructure and ballasted until the topsides is in engagement with the substructure. The legs of the substructure have sand jacks and shock-absorbers made from elastomeric members. The weight of the topsides is transferred to the substructure through the shock-absorbers. The sand-jacks are then used to lower the topsides into final steel-to-steel contact with the legs of the substructure. The barge also carries a topsides support structure comprising sand jacks with shock-absorbers. These sand-jacks are used to lower the topsides support structure from the topsides after the topsides have mated with the substructure.

U.S. Pat. No. 6,027,287 describes a load transfer system for placing a load on a barge onto a substructure, comprising a main transfer connector with a plurality of hydraulic jacks and a secondary transfer connector with a hydraulic lifting jack and a sand hopper with an opening valve for rapid flow-out of sand, the sand hopper having a top on which the hydraulic lifting jack is placed.

In the load transfer structures of U.S. Pat. No. 4,607,982 and U.S. Pat. No. 5,219,451 having sand jacks and neoprene pads or other resilient members, these members are shock-absorbers. All the load of the topsides is transferred through the shock-absorbers, and depending of the characteristics of the shock-absorbers, a gradually stiffer connection between the topsides and the transporter is established. The subsequent lowering of the sand jacks is for levelling and lowering the topsides. Thus the transfer of the topsides with these load transfer structures does not provide a contact phase with a flexible connection between the topsides and the transporter, followed by a lift-off phase with a stiff connection between the topsides and the transporter. These load transfer structures will be suitable for calm seas in which the motions of the transporter caused by the six horizontal and vertical orders of freedom are minimal compared to the North Sea summer operating conditions, and which there is no need for a contact phase with a flexible connection followed by a lift-off phase with a stiff connection.

BRIEF SUMMARY OF THE INVENTION

An object of the invention is to provide a method for removing a platform topsides from a substructure by a floatable, ballastable transporter. Which method shall provide a contact phase with a flexible connection between the transporter and the topsides, followed by a lift-off phase with a stiff connection between the transporter and the topsides. A further object is that the method shall provide positive contact between the transporter and the topsides both during the contact phase and the lift-off phase. A further object is to provide a load transfer unit of a floatable, ballastable transporter, which load transfer unit shall be flexible during the contact phase and stiff during the lift-off phase. A further object is to provide a combination of a load transfer unit of a floatable, ballastable transporter and a lift-bracket of a topsides, which shall provide positive contact between the transporter and the topsides both during the contact phase and the lift-off phase.

The objects are achieved by a method, a load transfer unit and a combination of a load transfer unit and a lift-bracket according to the claims.

The invention thus relates to a method for removing a platform topsides from a substructure by a floatable, ballastable transporter floating in the sea, the transporter is possibly moving due to motions of the sea, comprising the following steps:

a) Providing the transporter with load transfer units, each load transfer unit comprising
   - a drum having a hatch with a releasable hatch-cover forming a bottom of the drum, the drum is supported by the transporter,
   - a layer of particulate material resting on the hatch-cover,
   - a compression spring resting on the layer of particulate material,
   - a load-element which is slideable in the drum and rests on the spring, and which is adapted to contact the topsides.

b) Providing the topsides with lift-brackets adapted to the load-elements.

c) Ballasting the transporter and locating the transporter underneath the topsides with the load-elements of the transporter in alignment with the lift-brackets of the topsides, in a per se known manner.

d) Deballasting the transporter until the load-elements contact the lift-brackets. In heavy seas, due to the elliptical vertical motions of the transporter, this contact may be repeatingly established and lost. The springs provide flexible support for the loads elements, and this repeated establishing and re-establishing of contact will therefore cause only minor impacts which will cause no damage. In this step the springs act as shock-absorbers.

e) Further deballasting the transporter until the springs are partly or fully compressed, the springs thereby maintain upward forces on the load-elements and ensure that contact between the load-elements and the lift-brackets is maintained during possible heave motion of the transporter. This step corresponds to the above discussed contact phase. It is thereby provided a contact phase with a flexible connection with a positive contact between the transporter and the topsides. This flexible connection may be maintained for long time, maybe several hours, f) Releasing the hatch-covers to suddenly let out the particulate material from the drums, thereby lowering and relieving the springs, and simultaneously further deballasting the transporter, causing the lift-brackets to contact the drums, and causing the topsides to be lifted off the substructure. The springs are thereby totally or essentially deactivated, and the weight of the topsides is transferred to the transporter through the stiff drums. This step provides a change from the flexible connection to a stiff connection between the transporter and the topsides. The change from a flexible to a stiff connection preferably shall take place in seconds, which is made possible by the sudden release of the hatch-cover. The simultaneous deballasting of the transporter provides the lift-off of the topsides from the substructure. This step thereby corresponds to the above discussed lift-off phase.

Alternatively the topsides may have been cut from the substructure as a preparatory operation, i.e, before the arrival of the transporter. The topsides may have been restrained from movement by installing restraining clamps securing the topsides to the substructure. Additional upward force may be induced into the topsides by pumping out water from the transporter in a quantity which induces an additional 1000 to 2000 tonnes of upward force greater than the weight of the topsides. At the lift-off of the topsides from the substructure release mechanisms in the restraining clamps may be activated, which will create a rapid upward lift which will reduce the risk of damage should the topsides contact the substructure due to heave motion.

g) Further deballasting the transporter until a safe distance between the topsides and the substructure is reached, and remove the transporter from the substructure. The transporter is then ballasted, and the transporter can then be brought to a receiver for the transporter, e.g. a shallow draft vessel located inshore in sheltered waters or a pier.

The invention also relates to a load transfer unit as specified in step a), and a combination of a load transfer unit and a lift-bracket as specified in step b).

Preferably in order to ensure a positive contact in lateral directions during the lift-off phase, the upper portion of the drum and the lift-bracket should be adapted to lock relative movement in horizontal directions when the lift-bracket contacts the drum.

The drum may be located on structural steel of the transporter, and welded or bolted to this structural steel. Preferably, however, the drum is supported by the transporter via a hinged link arm, to enable positioning the load-elements in alignment with the lift-brackets, and to allow lateral motion of the transporter during the contact phase.

The compression spring may be a steel spring, either a helical spring or a disc spring, or a spring made from elastomeric material. Preferably the spring is formed by a laminate of a stiff material and an elastomeric material.

The load-element may take various forms, e.g. it can have the shape of a dowel or trunnion, and the lift-bracket can be provided with a corresponding opening.

BRIEF DESCRIPTION OF THE DRAWINGS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The invention will now be explained in more detail in association with a description of a specific embodiment, and with reference to the drawings which are given by way of illustration only, and thus are not limitative of the present invention, and, in which.

DETAILED DESCRIPTION OF THE INVENTION

Figure 1:
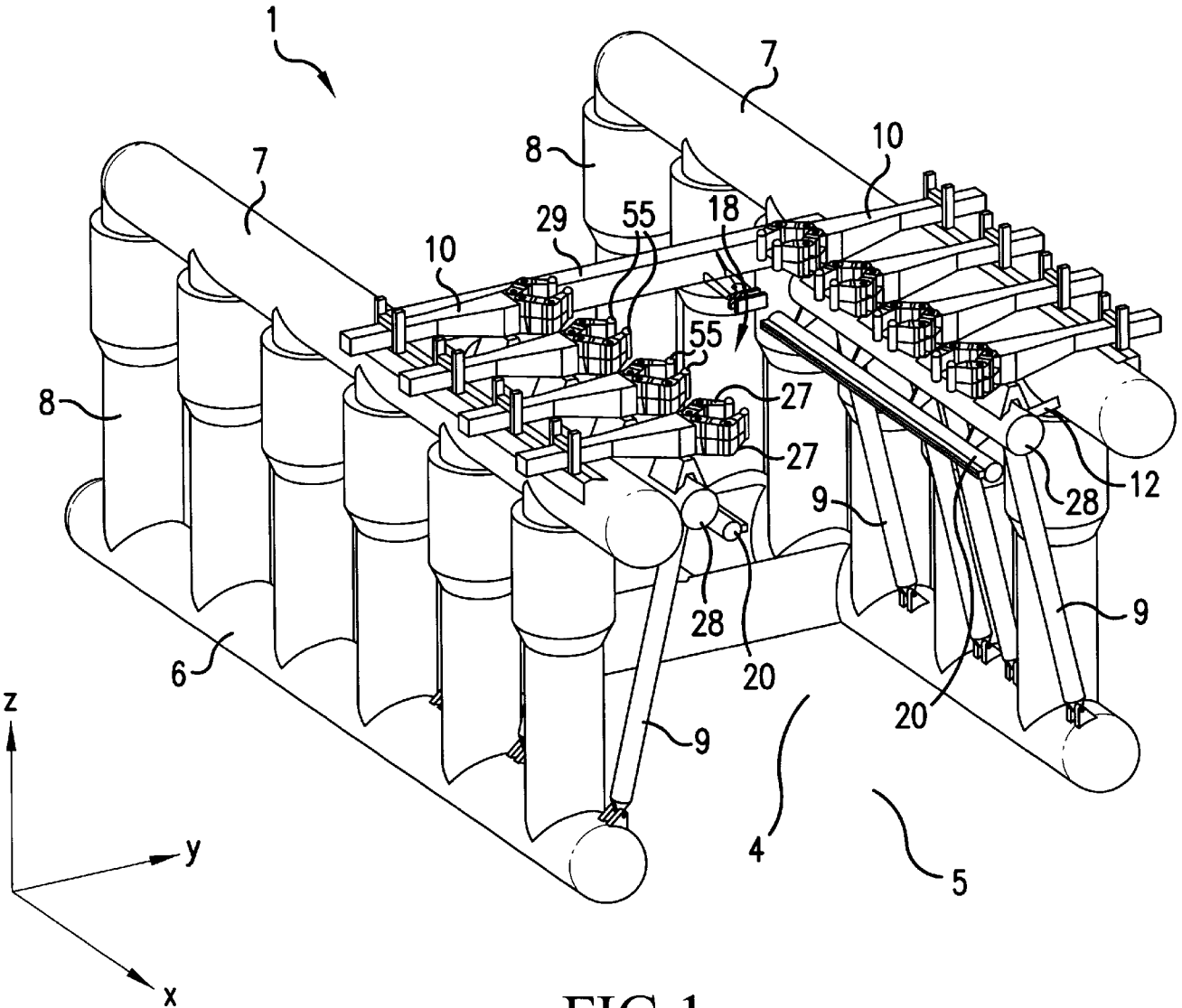
FIG. 1 is a perspective view of a transporter with load transfer units according to the invention.

FIG. 1 is a perspective view of a ballastable transporter 1 comprising lower pontoons 6 which define moonpool 4 and upper tubulars 7 which are located above and are parallel to the pontoons 6 and define an opening 18 above the moonpool 4. The moonpool 4 and the opening 18 essentially correspond to each other, thereby forming a vertical recess through the transporter 1, which recess is horizontally accessible in the surge direction, i.e. the direction x, from an open side 5 of the transporter. The transporter 1 also comprises structural elements which interconnect the pontoons 6 and the tubulars 7. In the illustrated embodiment the structural elements are columns 8 which are perpendicular to the pontoons 6 and the tubulars 7. A support bridge 29 interconnects the tubulars 7.

For ballasting purposes the pontoons 6 have ballasting chambers. Additionally the structural elements, i.e. the columns 8 and the tubulars 7, may also comprise ballasting chambers.

The transporter 1 floats in the sea, with the pontoons 6 down and the columns 8 vertical, in the direction z. References to "upper", "lower", "above", "below", "vertical" etc. in this patent application refers to the way the transporter floats in the sea.

Further, not illustrated, the transporter comprises piping, valves, pumps with motors and control equipment for performing the ballasting/deballasting. The transporter may be manned or unmanned, it may be moved by tugs or have its own propulsion machinery.

Figure 2:
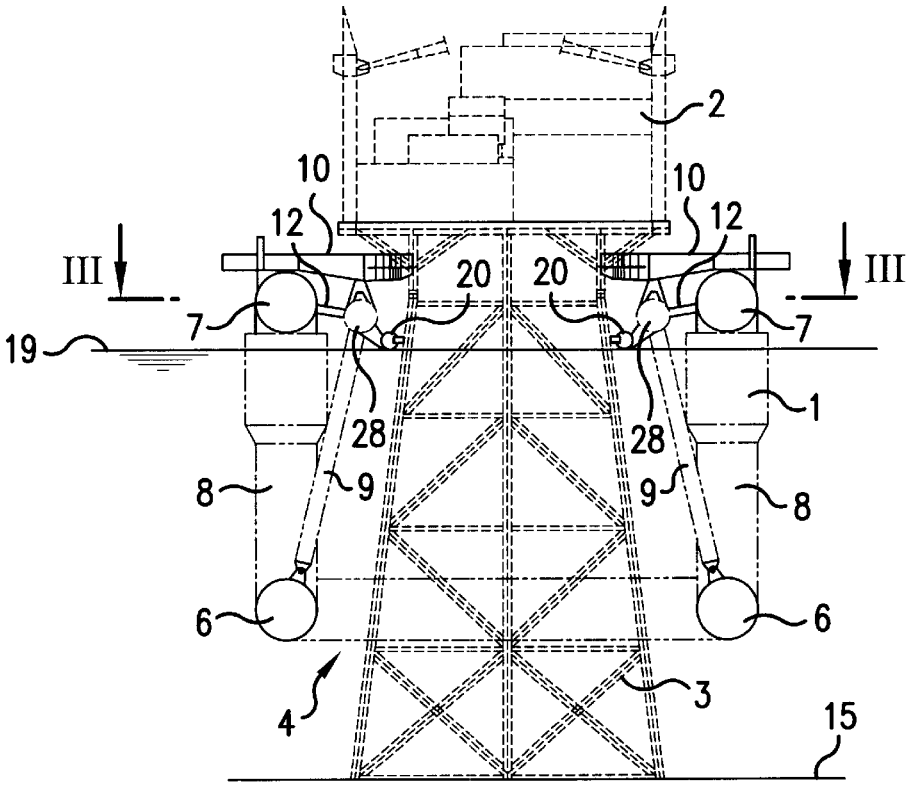
FIG. 2 is a side view of the transporter in FIG. 1 in the process of removing a platform topsides from a substructure.

FIG. 2 is a side view of the transporter 1 in the process of removing a platform topsides 2 from a substructure 3. The illustrated substructure 3 is a jacket, i.e. a steel trusswork, which rests on the seabed 15. The sea surface is identified by reference numeral 19. The substructure 3 and the topsides 2, which is a steel construction comprising one or more decks and equipment which is necessary for the intended purpose, together form an offshore platform.

In FIG. 2 the transporter 1 is floating besides the substructure 3, with the substructure located in the vertical recess formed by the moonpool 4 and the opening 18. This has been achieved by moving the transporter 1 with the open side 5 towards the substructure 3 in the direction x (see FIG. 1), until the substructure is located in the moonpool 4. Before moving the transporter 1, the draft of the transporter was adjusted by ballasting, to bring the elevation of support arms 10 for supporting the topsides 2 below the elevation of the underside of the topsides 2.

The transporter 1 is then deballasted, which leads to a reduced draft and a lifting (not illustrated) of the topsides 2, up from tire substructure 3. The transporter 1 with the topsides 2 is then free to move away (not illustrated) from the substructure 3. The removal of the topsides 2 from the substructure 3 is then completed.

Figure 3:
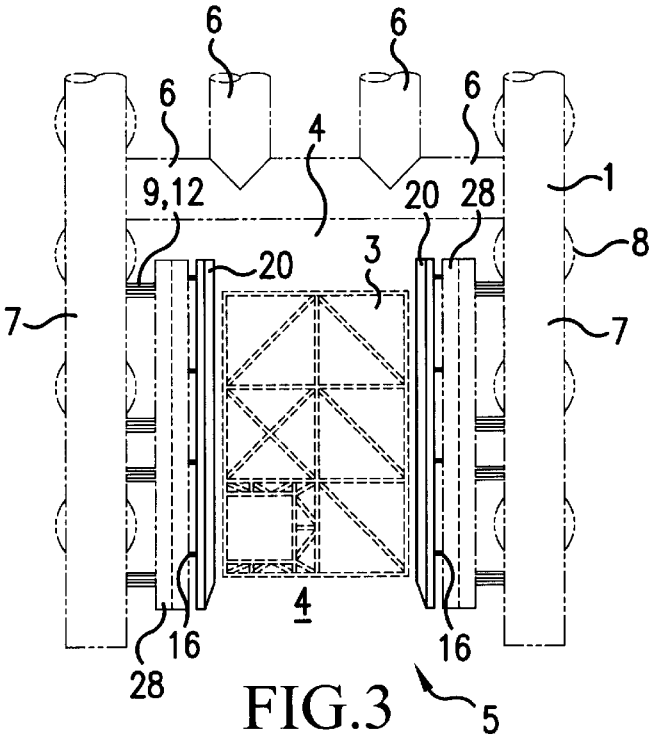
FIG. 3 is a sectional view defined by the arrows III—III in FIG. 2, illustrating the transporter and a substructure.

FIG. 3 is a sectional view defined by the arrows III—III in FIG. 2, illustrating the transporter 1 and the substructure 3 located in the moonpool 4.

Figure 4:
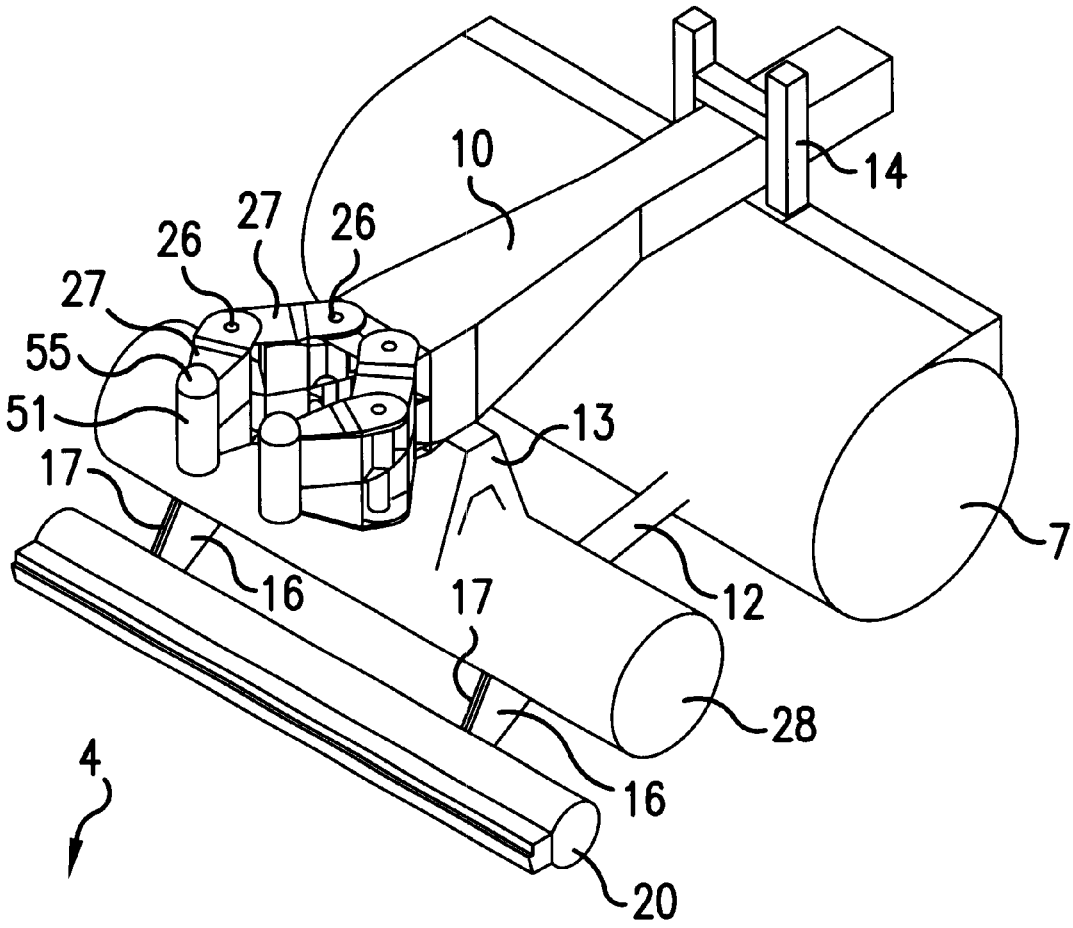
FIG. 4 is a perspective view of a part of the transporter, illustrating the load transfer units according to the invention.

FIG. 4 is a perspective view of a part of the transporter, illustrating a tubular 7 and a support arm 10 for the topsides. Both FIGS. 1, 2, 3 and 4 illustrates a support beam 28, which is located above the moonpool 4, and which is supported by struts 9 extending from the pontoon 6 (struts 9 are not illustrated in FIG. 4). The support beams 28 are tied to the tubulars 7 by adjustable tie-backs 12. The support arm 10 rests in one end on a chair 13 on the support beam 28 (see FIG. 4), and is in its other end secured to the tubular 7 by a support frame 14. The support arm 10 is further provided with two link arms 27 which are movable in the horizontal plane, i.e. the x and y directions (see FIG. 1) by hinges 26. The items designated by reference numerals 7, 10, 12, 13, 14, 26, 27 and 28 form part of a topsides load transfer structure, and may have various designs.

Further FIG. 4 illustrates two fender support structures 16 which are secured to the support beam 28, and on their upper side have sliding supports 17 sloping towards the moonpool 4. Fender members 20 are slidingly supported by the sliding supports 17 and are movable along the sliding supports 17.

The method for removing a platform topsides 2 from a substructure 3 by a floatable, ballastable transporter 1 floating in the sea is particularly relevant if the transporter is moving due to motions of the sea. The method of the invention comprises step a) to g). The invention will now be described with reference to FIGS. 5–8.

In step a) the transporter 1 is provided with load transfer units according to the invention. The load transfer unit comprises a drum 51 which is supported by the transporter 1 by being welded to the end of the hinged link arm 27 by a weld 65 (see FIGS. 4 and 5). The drum 51 has a lower hatch 57 (see FIG. 6) with a releasable hatch-cover 58 forming a bottom of the drum. The hatch-cover 58 is kept in place by a hinge bracket 62 and a number of holding brackets 63 distributed along the circumference of the bottom of the drum. The holding brackets 63 are in turn secured to each other by a hoop 64. A layer of particulate material 52 is located in a lower portion of the drum 51, resting on the hatch-cover 58. A compression spring 53 is located in an upper portion of the drum 51 and rests on the layer of particulate material 52, and a load-element 55 rests on the spring 53. The load-element 55 has an outer cylindrical surface 60 which corresponds to an inner cylindrical surface 59 of the drum 51, and the load-element is thereby slideable in the drum. The load-element 55 is adapted to mate with a corresponding lift-bracket 56 shown above the load-element 55.

In step b) the topsides 2 is provided with lift-brackets 56 adapted to the load-elements 55. The lift-bracket 56 is welded to the underside 50 of the topsides.

Figure 5:
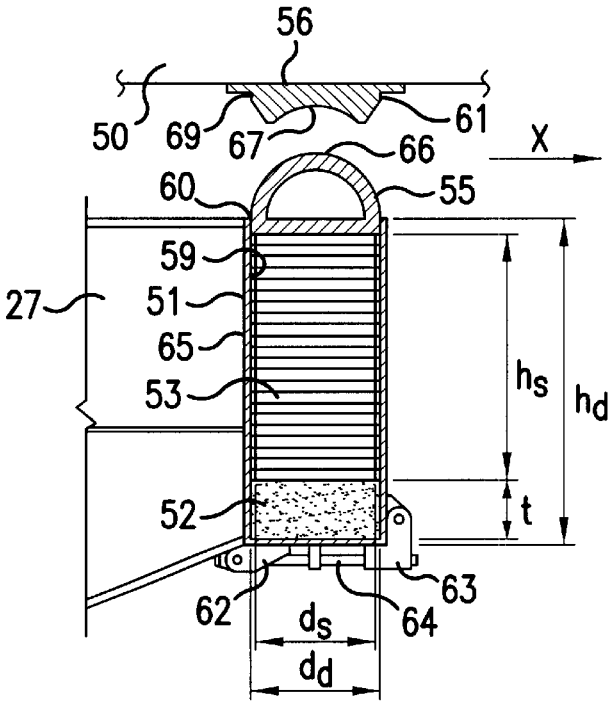
FIG. 5 illustrates a load transfer unit according to the invention and a lift-bracket of the underside of the topsides prior to contact.

In step c) the transporter 1 is ballasted and located underneath the topsides 2 with the load-elements 55 of the transporter 1 in alignment with the corresponding lift-brackets 56 of the topsides 2, i.e. the position which is illustrated in FIG. 5. The spring 53 is in a non-compressed state, and the load-element 55 projects above the top of the drum 51.

If the sea is moving, the transporter with the load-element 55 will move in the horizontal directions x, y, see FIG. 1, while the substructure and the topsides with the lift-bracket 56, which rests on the sea bed, is almost stationary. The hinged link arm 27, which may be provided with a not illustrated hydraulically actuated motion control system, i.e. hydraulic motors or cylinders which rotate the links of the link arms 27 in the hinges 26, (see FIG. 4) in accordance with instructions from an operator or a computerised control system, assists in positioning the drum 51 in horizontal directions x, y to align the load-elements 55 with the lift-brackets 56. The load-element 55 and the lift-bracket 56 have convex respectively concave hemispherical surfaces 66, 67 with the same curvature, to further assist in aligning the load-element 55 and the lift-bracket 56, and to allow the load-element to swivel within the lift-bracket 56.

Figure 6:
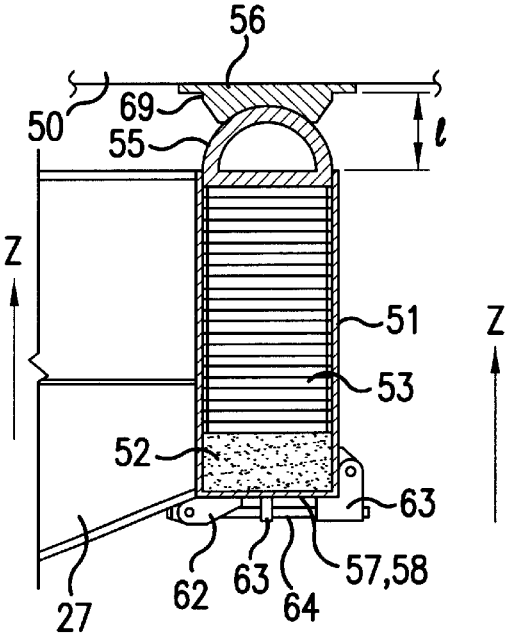
FIG. 6 illustrates the load transfer unit and the lift-bracket in the initial contact.

In step d) the transporter 1 is deballasted until the load-elements 55 contact the lift-brackets 56, which is illustrated in FIG. 6. The deballasting has caused the transporter and the load transfer unit to raise in the direction z, and the load-element 55 has reached the initial contact with the lift-bracket 56. Vertical and horizontal elliptical motions of the transporter may cause the load-element 55 to repeatingly lose and re-establish its contact with the lift-bracket 56. If this happens, misalignment may occur between the load-elements 55 and the lift-brackets 56 causing possible damage to the transporter and the structures.

Figure 7:
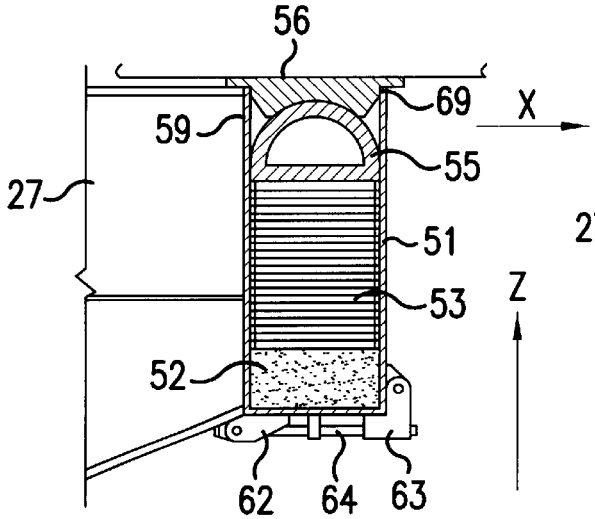
FIG. 7 illustrates the load transfer unit and the lift-bracket when contact between the lift-bracket and a drum of the load transfer unit has been established.

In step e) the transporter 1 is further deballasted until the springs 53 are partly or fully compressed, to a position which is somewhere between what is illustrated in FIGS. 6 and 7. Heave motion of the transporter 1 may cause the link-arm 27 with the load transfer units to move up and down in vertical direction z, the positions of FIGS. 6 and 7 illustrating the extreme positions of the link arm 27 relative to the underside 50 of the topsides. During this heave motion the compressed spring 53 will exert an upwardly directed continuous force on the load-element 55, which ensures that contact between the load-elements 55 and the lift-brackets 56 is maintained. Should the vertical motions cause some separation of one or more load-elements 55 and the respective lifting brackets 56, the spring 53 acts as a shock-absorber ensuring that possible impacts are small.

From the spring 53 the load is transferred to the layer of particulate material 52 in the lower portion of the drum 51, and further to the hatch-cover 58, the hinge-bracket 62 and the holding brackets 63. From the hinge-bracket 62 and the holding brackets 63 the load is transferred to the drum 51, and further to the link arm 27. Since the load is transferred through the spring 53, there is a flexible connection between the transporter 1 and the topsides 2. The flexibility of this connection depends on the elasticity of the spring 53. In order to ensure that the topsides rests stable on the substructure 3, only a part of the weight of the topsides is transferred through the springs. The purpose of the springs is thus not to transfer all the weight of the topsides, but by means of their flexibility maintain a positive contact between the transporter 1 and the topsides 2 during the heave motion of the transporter. Step e) corresponds to the contact phase which is discussed in the introductory part of the description. The flexible connection between the transporter and the topsides may be maintained for long time, maybe several hours.

Figure 8:
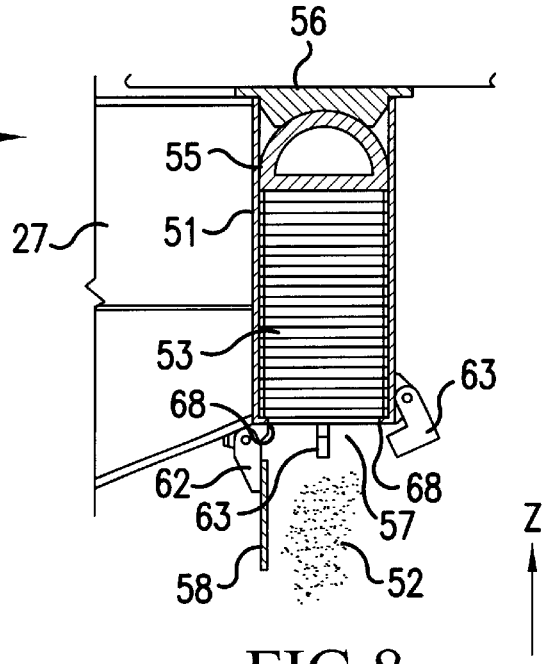
FIG. 8 illustrates the load transfer unit and the lift-bracket after particulate material has been let out from the drum.

In step f) the hatch-covers 58 are released to suddenly let out the particulate material 52 from the drums 51. The releasing of the hatch-covers 58 is done by releasing the hoop 64, which due to the weight of the particulate material causes the hinge bracket 62 and the holding brackets 63 to rotate away from the hatch 57 and thereby release the hatch-cover 58. The particulate material 52 then falls down, into the sea, and the spring 53 is lowered onto one or more stops 68 located in the bottom of the drum 51, as illustrated in FIG. 8. Depending on the design of the load transfer unit, the spring will be partly or totally decompressed, i.e. partly or totally relieved, which causes the part of the weight of the topsides 2 which is transferred to the transporter 1 via the springs 53 to be either reduced or eliminated, respectively.

Simultaneously the transporter 1 is further ballasted, which means that the buoyancy of the transporter raises the transporter. The lift-brackets 56 thereby contact the drums 51, and it is provided a stiff connection between the transporter and the topsides. As discussed, if the load transfer unit is so designed, some load may still be transferred through the spring, but this is insignificant for the stiffness of the connection. The deballasting of the transporter 1 further causes the transporter to lift the topsides 2 off the substructure 3. The hinges 26 of the link arms 27 may now be locked by mechanical locks, to prevent horizontal relative movement of the topsides and the transporter.

Thus step f) corresponds to the lift-off phase which is discussed in the introductory part of the description.

The change from flexible connection between the transporter and the topsides to the stiff connection should take place in very short time, preferably only a few seconds. In order to provide maximum stability and minimum impacts the actual point of time for releasing the hatch-covers an letting out the sand and deballasting the transporter will have to be decided based on the actual operating situation, taking the wave motion into consideration. In order to ensure a quick deballasting of the transporter during the lift-off of the topsides, ballast water should be dumped from ballast tanks above the sea water level and/or rapidly pumped out from the tanks.

An alternative is to having pre-cut the topsides 2 from the substructure 3 and installed quick-releasing restraining clamps securing the topsides 2 to the substructure 3 prior to the deballasting of the transporter 1 and locating the transporter underneath the topsides 2. These clamps may include hydraulic or explosive bolts or other quick-release mechanisms. Then the transporter may have been deballasted to induce an upward force greater than the weight of the topsides. During this deballasting water in a quantity which induces an additional force of 1000 to 2000 tonnes may be pumped out from the transporter. Then, during step f) the transporter 1 can be lifted by a quick release of the restraining clamps securing the pre-cut topsides 2 to the substructure 3 creating a quick upward lift of the transporter and the topsides.

In step g) the transporter 1 is further deballasted until a safe distance between the topsides 2 and the substructure 3 is reached, and then the transporter is removed from the substructure. The removal of the topsides is then completed. The topsides is then secured to the transporter by not illustrated horizontal sea-fastening, e.g. stays or chains, and the transporter can then be ballasted and moved to a receiver for the topsides, e.g. a construction yard.

Preferably, in order to avoid impacts between the drum 51 and the lift-bracket 56, see FIG. 5, the height $h_d$ of the drum 51, the thickness t of the layer of particulate material 52, the height $h_5$ and the elasticity of the spring 53 should be so selected relative to the load on that particular load transfer unit that the topsides lift-bracket 56 does not contact the drum 51 until the step of releasing the hatch-cover 58.

In order to ensure a stiff connection between the transporter and the topsides also in the horizontal directions x, y during lift-off, it is preferred that the drum 51 is adapted to secure the lift-bracket 56 in horizontal directions x, y when the lift-bracket 56 contacts the drum 51, which it does during the lift-off phase. With reference to FIGS. 5 and 7, this securing is achieved by the fact that the drum 51 has a cylindrical inner surface 59 and the lift-bracket 56 has projection 69 with a corresponding cylindrical outer surface 61 which is lowered into the drum 51 when the lift-bracket 56 contacts the drum 51. It is thereby provided a combination of a load transfer unit and a lift-bracket 56 of the underside 50 of the topsides in which the upper portion of the drum 51 and the lift-bracket 56 are mutually adapted to lock relative movement in horizontal directions x, y when the lift-bracket 56 contacts the drum 51.

The invention depends on a correct selection of the design parameters of the load transfer unit. A typical jacket can have eight legs. With reference to FIG. 1, there is one support arm 10 with two link arms 27, and thus also two load transfer units, for each leg (the jacket with its legs is not illustrated), which makes a total of 16 load transfer units.

A spring in a load transfer unit for removing a very heavy top sides may be designed for a static load of 1000 tonnes, and a dynamic load, i.e. load due to the heave motion, of plus/minus 500 tonnes. For this design, see FIG. 5, the internal diameter $d_d$ of the drum can be 1260 mm, and the height $h_d$ of the drum can be 3250 mm.

The illustrated spring is a laminated elastomeric spring which is made from layers of elastomeric rubber with intermediate, stabilising stiff steel plates. A rubber with dampening characteristics, i.e. a rubber which absorbs energy during its compression and decompression can be used. This will, however, cause heat development in the spring, and consequently the elastomeric material should have a low dampening. An example of an elastomeric material which can be used in the spring is neoprene rubber.

For this design of the load transfer unit, the spring may have a diameter $d_5$, of 1200 mm and a height $h_5$ of 2500 mm, and be made up of layers of the elastomeric material with a thickness of 103 mm and intermediate steel plates with a thickness of 10 mm. This gives a spring constant of 2000 tonnes/meter.

Thus, for a static load of 1000 tonnes, the spring will be compressed 500 mm. Further, the dynamic load of 500 tonnes, superimposed on the load of 1000 tonnes, will make the spring flex between a compression of 250 mm and 750 mm. With reference to FIG. 6, a preferred distance 1 between the top of the drum 51 and the lift-bracket 56 when there is an initial contact between the load-element 55 and the lift-bracket 56 is 800 mm, since this will ensure a clearance of 800−750 mm =50 mm between the top of the drum 51 and the lift-bracket 56 when there is a full static and dynamic, load on the load transfer unit. In an actual lifting operation, however, there will be various static loads on the different load transfer units, and the dynamic load cannot be accurately predicted. Thus, the actual clearance between the top of the drum 51 and the lift-bracket 56 prior to the opening of the hatches for the particulate material may vary for the different load transfer units.

Various types of particulate material can be used. A preferred material is sand, which is a low-cost, easy available particulate material which can easily be let out from the drum by the hatch. In order to achieve the above functions, the thickness t of the sand layer may be approximately 600 mm.

The other principal elements of the load transfer unit i.e., the drum, the load-element, the hatch-cover and related items and the lift-bracket can be made from steel.

It should be understood that considerations similar to the above will apply when the load transfer units are located on a barge or a ship which is used in the removal of a topsides from a substructure.

What is claimed is:

1. A method for removing a platform topsides from a substructure by a floatable, ballastable transporter floating in the sea, the transporter is movable due to motions of the sea, comprising the following steps:

a) providing the transporter with load transfer units, each load transfer unit comprising
   - a drum having a hatch with a releasable hatch-cover forming a bottom of the drum, the drum is supported by the transporter,
   - a layer of particulate material resting on the hatch-cover,
   - a compression spring resting on the layer of particulate material,
   - a load-element which is slideable in the drum and rests on the spring, and which is adapted to contact the topsides, b) providing the topsides with lift-brackets adapted to the load-elements, c) ballasting the transporter and locating the transporter underneath the topsides with the load-elements of the transporter in alignment with the lift-brackets of the topsides, d) deballasting the transporter until the load-elements contact the lift-brackets, e) further deballasting the transporter until the springs are partly or fully compressed, the springs thereby maintain upward forces on the load-elements and ensure that contact between the load-elements and the lift-brackets is maintained during possible heave motion of the transporter, f) releasing the hatch-covers to suddenly let out the particulate material from the drums, thereby lowering and relieving the springs, and simultaneously further deballasting the transporter, causing the lift-brackets to contact the drums, and causing the topsides to be lifted off the substructure, and g) further deballasting the transporter until a safe distance between the topsides and the substructure is reached, and remove the transporter from the substructure.

2. The method according to claim 1, wherein, for a particular load transfer unit, the height ($h_d$) of the drum, the thickness (t) of the layer of particulate material, the height ($h_s$) and the elasticity of the spring are so selected relative to the load on that particular load transfer unit that the topsides lift-bracket does not contact the drum until the step of releasing the hatch-cover.

3. The method according to claim 1 or 2, wherein the upper portion of the drum and the lift-bracket are adapted to lock relative movement in horizontal directions (x) when the lift-bracket contacts the drum.

4. The method according to claim 1, wherein the drum is supported by the transporter via a hinged link arm to enable positioning the load-elements in alignment with the lift-brackets during the step c).

5. The method according to claim 1, wherein prior to the step c), the topsides have been cut from the substructure and restrained from movement by installing restraining clamps securing the topsides to the substructure.

6. The method according to claim 5, wherein the transporter by deballasting induces an upward force greater than the weight of the topsides, and the step f) includes by quick release of the restraining clamps creating a quick upward lift of the transporter and the topsides.

7. A load transfer unit of a floatable, ballastable transporter, for transferring load from a platform topsides to the transporter during removal of the topsides from a substructure, the removal is carried out by ballasting the transporter, locating the transporter underneath the topsides and deballasting the transporter, causing load transfer units of the transporter to contact and lift the topsides off the substructure, the load transfer unit comprises:

a drum having a hatch with a releasable hatch-cover forming a bottom of the drum, the drum is supported by the transporter, a layer of particulate material resting on the hatch-cover, a compression spring resting on the layer of particulate material, a load-element which is slideable in the drum and rests on the spring, and which is adapted to contact the topsides, the hatch cover is kept in place by a hinge bracket and a number of holding brackets distributed along the circumference of the bottom of the drum, the holding brackets are secured to each other by a hoop.

8. The load transfer unit according to claim 7, wherein the load-element in a non-compressed state of the spring projects above the top of the drum.

9. The load transfer unit according to claim 7 or 8, wherein the spring is formed by a laminate of a stiff material and an elastomeric material.

10. The load transfer unit according to claim 7, comprising one or more stops for the spring are located in the bottom of the drum.

11. The load transfer unit according to claim 7, wherein the drum is supported by the transporter via a hinged link arm.

12. A combination of a load transfer unit and a lift-bracket wherein the load transfer unit is for a floatable, ballastable transporter, for transferring load from a platform topsides to the transporter during removal of the topsides from a substructure, the removal is carried out by ballasting the transporter, locating the transporter underneath the topsides and deballasting the transporter, causing load transfer units of the transporter to contact and lift the topsides off the substructure, the load transfer unit comprises:

a drum having a hatch with a releasable hatch-cover forming a bottom of the drum, the drum is supported by the transporter, a layer of particulate material resting on the hatch-cover, a compression spring resting on the layer of particulate material, a load-element which is slideable in the drum and rests on the spring, and which is adapted to contact the topsides, and wherein the lift-bracket is attached to an underside of the topsides, characterized in that the upper portion of the drum and one loft-bracket are adapted to lock relative movement in horizontal directions (x) when the lift-bracket contacts the drum.

13. The combination of a load transfer unit and a lift-bracket according to claim 12, wherein the drum has a cylindrical inner surface and the lift-bracket has a projection with a corresponding cylindrical outer surface which is lowered into the drum when the lift-bracket contacts the drum.

14. The combination of a load transfer unit and a lift-bracket according to claim 12 or 13, wherein the load-element and the lift-bracket have convex and concave hemispherical surfaces, respectively, with the same curvature, to assist in aligning the load-element and the lift-bracket, and to allow the load-element to swivel within the lift-bracket.

* * * * *